United States Patent [19]

Schäfer

[11] 4,055,779

[45] Oct. 25, 1977

[54] GAS DISCHARGE LAMP

[75] Inventor: Jürgen Schäfer, Niedermittlau, Germany

[73] Assignee: Original Hanau Quarzlampen GmbH, Hanau, Germany

[21] Appl. No.: 601,570

[22] Filed: Aug. 1, 1975

[30] Foreign Application Priority Data

Aug. 9, 1974 Germany ..... 2438372

[51] Int. Cl.[2] ..... E05C 7/06

[52] U.S. Cl. ..... 313/220; 313/491

[58] Field of Search ..... 313/220, 491, 317, 493

[56] References Cited

U.S. PATENT DOCUMENTS

| | | | |
|---|---|---|---|
| 2,103,159 | 12/1937 | Kingdom | 313/220 |
| 2,229,962 | 1/1941 | De Reamer | 313/220 |
| 2,935,637 | 5/1960 | Cortese | 313/491 |

OTHER PUBLICATIONS

Yu, G. Anikiev, Optics & Spectroscopy, vol. 32, No. 2, Feb. 1972, pp. 204–206.

*Primary Examiner*—M. Tokar

*Attorney, Agent, or Firm*—Sughrue, Rothwell, Mion, Zinn and Macpeak

[57] ABSTRACT

A gas discharge lamp is disclosed which has a generally straight, tubular configuration and exhibits an approximately constant irradiation power along a greater portion of its length than previous lamps. This feature is achieved by forming the radiation body of the lamp into three sections along its length, a central sectors and two end sectors, wherein the central sector has different cross section than the two end sectors. In one embodiment, the central sector has a larger cross section than either of the end sectors.

3 Claims, 2 Drawing Figures

GAS DISCHARGE LAMP

BACKGROUND OF THE INVENTION

1. Field of the Invention

This invention relates to a gas discharge lamp, having a straight tubular radiation body.

2. Prior Art

Due to their good radiation capacity, gas discharge lamps are often used for irradiation purposes. For certain fields of application it is necessary that the irradiation power of the lamp be constant or almost constant along its entire length. When the lamp is used in copying devices, the clearness and the contrast of the copied letters over the width of the paper sheet depends essentially on a constant irradiation power across the width of the document being copied. Sometimes an overexposure of the edges is desired, in order to compensate for the marginal drop caused by the optical system of the copying device.

Lamps of this type are also used in devices for the automatic testing of moving material for holes, cracks or other faults, by monitoring the change of the light transmitting quality of the material. The material is linearly exposed to a constant irradiation power across its width. If there are defective spots in the material width, then there will appear changes of the light intensity on that side of the material disposed away from the light source, which will be detected by photo-electric receivers.

In order to generate a linear area with an almost constant irradiation power, oblong light sources, e.g. fluorescent tubes, have been used in conjunction with cylindrical lenses. The irradiation power of the conventional fluorescent tubes charged with neon, argon, krypton or nitrogen, is approximately constant only in the middle portion thereof. The irradiation power continually decreases in a direction toward the ends of the fluorescent tube. The radiant intensity of the lamp itself is constant to the ends, but the irradiation power measured in a plane parallel to the axis of the lamp decreases toward the end portions of the lamp. Therefore, with the conventional fluorescent tubes one can generate oblong areas with almost constant irradiation power on objects only by using corresponding diaphragms. Thus it can be seen that a considerable portion of the radiation emitted by the light source will not be utilized, resulting in a smaller luminous efficiency than is desireable.

Also, in many instances incandescent lamps are used wherein the lamps have a tubular lamp body, in which is arranged a helix running along the lamp axis. In order to intensify the irradiation power of these tubular incandescent lamps in the vicinity of the connecting ends, it is possible to provide the helix wire with more turns per unit length at both ends than in the middle portion of the incandescent lamp. Thus a greater portion of the generated radiation is utilized. However, due to such a complicated construction, the incadescent lamps are difficult and costly to manufacture. It is further known in the art to contiguously arrange individual lamps along a straight line, in order to obtain a rather uniform irradiation power (German Registered Article Specification No. 6,944,880).

SUMMARY OF THE INVENTION

It is an object of the invention to develop a gas discharge lamp having a rather simple construction, and a longer axially extending range of the lamp which can be utilized for the generation of an irradiation power of generally constant value within preset limits.

According to the invention the lamp has a radiation body wherein sectors adjacent to the electrodes for the current supply have a different and preferably smaller cross section than a central sector. With this arrangement one can obtain an irradiation power measured on a length running parallel to the longitudinal axis of the gas discharge lamp, having two peak values in the area of the ends of the lamp body, and a slightly lower value in the area of the central sector. The irradiation power drops below the value prevailing in the central sector only at a very short distance from the ends of the lamp body determined by the spacing of the electrodes. The differences in cross section of the individual sectors can be balanced in respect to each other in such a manner that the irradiation power does not exceed or fall below the limit values required for the respective field of application. It is already known ("Ultraviolet Rays" by A. E. Herbert Meyer and Ernst Otto Seitz, Berlin 1942, editor Walter de Gruyter & Co., page 29) that the radiation capacity of a gas discharge lamp is dependent upon the tube diameter of the lamp body. However, the constant tube diameter has since been matched, especially for the steam pressure in the glass body and the strength of current, in such a manner that a rather high radiation capacity can be obtained. Contrary thereto, the arrangement according to the invention is based on the principle of obtaining a desired radiation flow by changing the cross section in an axial direction of a lamp body.

An essential advantage of this arrangement can be seen wherein considerably less radiation losses will occur by shading or blocking some portions of the radiation body, since the sections which are unsuitable for irradiation constitute only a small portion of the axial length. Therefore, the arrangement has a high radiation output for a given length. Further, this arrangement can also be economically manufactured.

Preferably the cross section of the radiation body will be constant over the length of each sector. This arrangement excels by its especially simple construction.

In an advantageous embodiment of a xenon-low pressure lamp, the central sector and the two end sectors adjacent to the electrodes are approximately of the same axial length. With this arrangement, there are two peak values of irradiation power measured on a length running parallel to the longitudinal axis of the gas discharge lamp, which will be located approximately in the middle of each end section adjacent to the electrodes. In one embodiment the cross section of the central sector is about 1.5 to 2 times bigger than the cross section of each of the end sectors adjacent to the electrodes. For a predominating number of application fields, as for example, in width-scanning, an irradiation power is permissible that varies within a preset zone of tolerance. If the level of the irradiation power of the arrangement according to the invention is compared with the level of irradiation power of a conventional constant diameter gas discharge lamp of the same length, of which the constant cross section corresponds to the arithmetic means of the two different cross sections of the embodiment of the invention, then the irradiation power above a given threshold value of the conventional arrangement is located in a section extending over approximately 70% of the axial length of the radiation body. On the other hand, in the arrangement according to the invention the irradiation power above a given threshold extends over approximately 90% of the axial length of the radiation body.

In one embodiment the gas discharge lamp according to the invention is used as a light source in a copying apparatus. It is a special advantage of this embodiment that due to the good utilization of the radiation emitted from the ends of the gas discharge lamp, only little dead space is required, extending on both sides of the edges of the printing paper up to the walls of the copying apparatus. Thus it is possible to construct the copying apparatus in such a manner that its width exceeds the width of the printing paper only by a small dimension. Thus the space utilization in copying apparatus is improved.

In one embodiment of the invention, the radiation body is made of quartz glass and entraps xenon. With this arrangement an almost constant irradiation power can be obtained over a considerable length of the lamp in which the energy distribution is approximately equal to solar radiation. Preferably such a gas discharge lamp is used as a light source in a light-proof and weather-proof testing apparatus. Due to the high usage of the generated radiation of the gas discharge lamp, this arrangement permits the construction of compact testing apparatus, in which relatively large-sized samples can be exposed to strain produced by light. For example, it is possible to test samples of textile fabric, having certain large-sized designs printed thereon in different colors.

BRIEF DESCRIPTION OF THE DRAWINGS

In the following the invention is described in more detail by means of a preferred embodiment shown in the attached drawings, upon consideration of which other features as well as advantages will be apparent.

DETAILED DESCRIPTION OF THE PREFERRED EMBODIMENT

Figure 1:
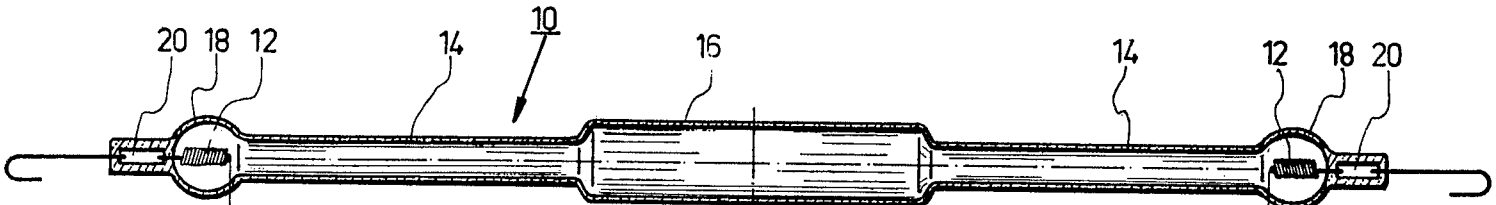
FIG. 1 is a longitudinal section of a gas discharge lamp according to the present invention.

A gas discharge lamp according to the invention consists of a straight tubular radiation body 10, at both ends of which are arranged spherical enlargements 18, in which there are the electrodes 12 for the current supply. The electrodes 12 are connected with molybdenum foils 20, the foils 20 being included in fused parts joined to the enlargements 18 on the sides away from the radiation body 10. The molybdenum foils 20 are connected to wires (not shown) which extend from the fused part and are connected with a current supply (not shown) to supply electrical current to the lamp.

The radiation body 10, the enlargements 18 and the fused parts are made of quartz glass. Xenon is entrapped in the radiation body 10 and in the spherical enlargements 18. Upon switching on the electrical current, the electrodes 12 are heated up. Through the heat, electrons are emitted from the electrodes 12. Thereby the gas discharge in the lamp 10 is started, emitting a radiation that has approximately the same spectral energy distribution as solar radiation. The gas discharge preponderantly takes place in the radiation body 10, which, therefore, emits almost the entire radiation to the surroundings.

The radiation body 10 is composed of three sectors 14, 14 and 16. While the sectors 14 adjacent to the electrodes 12 are of the same length and have the same cross section, the central sector 16 has a greater cross section in regard to the end sectors 14. The cross section of the radiation body 10 is constant over the whole length of each sector 14, 14 and 16. The central sector 16 and the sectors 14 adjacent to the electrodes 12 are approximately of the same length. The cross section of the central sector 16 is approximately 1.5 to 2 times greater than the cross section of each of the two sectors 14 adjacent to the electrodes 12. The axial length of the radiation body is indicated at 22.

Figure 2:
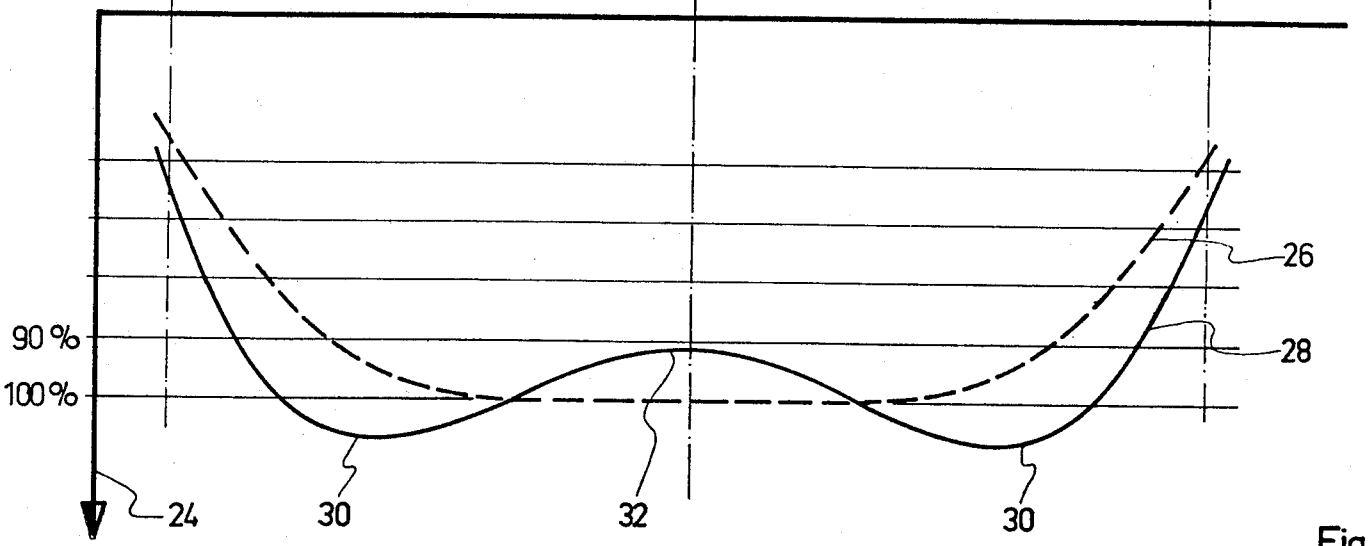
FIG. 2 is a graphic representation of the irradiation power, measured along a length parallel to the longitudinal axis, versus the axial length of a gas discharge lamp according to the present invention and a conventional gas discharge lamp.

FIG. 2 shows the characteristic curves of the radiation power, measured on a length running parallel to the longitudinal axis of a gas discharge lamp, for a conventional type lamp, line 26, and the lamp shown in FIG. 1, line 28, as a function of the axial length of the lamps. It is assumed that the radiation bodies of the conventional type lamp as well as of that shown in FIG. 1 have the same lengths 22. In the FIGURE, the length along the axis of the lamp is shown as the abscissa, and the percentage value of the irradiation power is shown as the ordinate. The cross section of the radiation body of the conventional lamp is constant along the axial length 22 and corresponds to a desired mean value of the two different cross sections of the gas discharge lamp according to FIG. 1.

The maximum irradiation power that can be obtained from the conventional gas discharge made of the same material as the lamp according to FIG. 1 and entrapping the same gas, is specified in FIG. 2 with the value of 100%. This value is obtained along the center of the conventional gas discharge lamp. The characteristic line 26 of the irradiation power of the conventional gas discharge lamp runs on both sides of the center of the radiation body almost constant over a certain length and then decreases in a direction toward the ends of the radiation body. In most fields of application, e.g. when scanning material widths for defects, or when blueprinting, it is required that the irradiation power over the length of the lamp must not fall below a certain minimum value. Such a minimum value is specified in FIG. 2 in direction of the ordinate 24 with 90%. With the conventional gas discharge lamp, the irradiation power is above this minimum value over approximately 70% of its axial length. When using the conventional gas discharge lamp for generating an irradiation power with the above explained threshold, 30% of the axial length, i.e. 15% at each end of the lamp, would thus have to be shaded or, respectively, be blocked out by a screen. However, the ends cannot be switched off in order to prevent losses of energy. Therefore, these lamps must be longer for a given amount of uniformly lighted sample length, in order to exclude the length below the threshold level. Thus, the dimensions of the apparatus would be correspondingly great.

The characteristic line of the irradiation power of the gas discharge lamp shown in FIG. 1, is indicated at 28 in FIG. 2. The characteristic line 28 is ascending on both sides of a value 32 existing in the middle of the central sector 16 and reaches two peak values 30, situated approximately in the center of the sectors 14. After the peak values 30 the characteristic line drops in the direction of the ends of the radiation body 10. The value 32 is somewhat less than the value 100%, while the maximum values 30 are somewhat above the value of 100%. In the center of the radiation body 10, however, the value 32 does not fall below the threshold indicated with 90%. As can be seen from FIG. 2, the length of the radiation body 10, generating an irradiation power above the threshold of 90%, is approximately 90% of the axial length of the lamp. Thereby, a high percentage of the generated radiation can be utilized for the respective applications. The arrangement shown in FIG. 1 has a high radiation output for a given length. With this lamp, the uniformly lighted sampled length is greater for the same length of conventional lamp, or this lamp could be built shorter for a given irradiation length than the lamp with a constant cross section.

The gas discharge lamp shown in FIG. 1 can be used in copying apparatus. The gas discharge lamp, therefore, requires only little space exceeding the width of the printing paper to be handled. Therefore, the width of the copying apparatus can be limited to a minimum dimension. This will result in advantages during transportation and with respect to the space requirement of copying apparatus.

In addition thereto, the gas discharge lamp according to FIG. 1 can be used in light-proof and weatherproof-testing apparatus. Due to the good utilization of the emitted radiation in the axial direction of the radiation body, it is possible with such testing apparatus, in which the lamps usually are vertically arranged, not to extend the height of the apparatus beyond a dimension restricting its operation. In spite of the relatively compact construction of the testing apparatus, it is nevertheless possible to test largesized samples.

Textile fabric samples, on which are printed large-sized designs comprising different colors, may be tested by means of light-proof and weatherproof-testing apparatus that can be advantageously manufactured utilizing the lamp of FIG. 1.

What we claim is:

1. In a vapor discharge lamp the improvement comprising said generally straight tubular radiation body being divided within that portion between the ends of the electrodes into a central sector and end sectors disposed on each side thereof, said sectors being of generally equal length and of generally constant cross sectional area and wherein the cross sectional area of the end sectors is less than that of the center sector for effective uniform light radiation above a predetermined minimum threshold power over approximately 90% of the length of the tubular radiation body between electrodes.

2. A gas discharge lamp according to claim 1 characterized thereby that the cross sectional area of the central sector is in the range of from 1.5 to 2 times greater than the cross section of the two end sectors adjacent thereto.

3. A gas discharge lamp according to claim 1 wherein the radiation body is made of quartz glass and entraps xenon therein.

* * * * *